US009995447B2

(12) United States Patent
Rooymans

(10) Patent No.: US 9,995,447 B2
(45) Date of Patent: Jun. 12, 2018

(54) MATERIALS AND PROCESS FOR SPATIAL S/P RATIO DISTRIBUTION

(71) Applicant: Gemex Consultancy B.V., Oss (NL)

(72) Inventor: Johannes Otto Rooymans, Oss (NL)

(73) Assignee: Gemex Consultancy B.V., Oss (NL)

( * ) Notice: Subject to any disclaimer, the term of this patent is extended or adjusted under 35 U.S.C. 154(b) by 0 days. days.

(21) Appl. No.: 15/109,162

(22) PCT Filed: Dec. 30, 2014

(86) PCT No.: PCT/NL2014/050922

§ 371 (c)(1),
(2) Date: Jun. 30, 2016

(87) PCT Pub. No.: WO2015/102491

PCT Pub. Date: Jul. 9, 2015

(65) Prior Publication Data

US 2016/0327225 A1 Nov. 10, 2016

(30) Foreign Application Priority Data

Dec. 30, 2013 (NL) ..... 2012037

(51) Int. Cl.
*F21V 1/00* (2006.01)
*F21V 5/00* (2018.01)
(Continued)

(52) U.S. Cl.
CPC ..... *F21S 8/086* (2013.01); *F21V 7/00* (2013.01); *F21V 7/0016* (2013.01); *F21S 8/085* (2013.01);
(Continued)

(58) Field of Classification Search
CPC ..... F21S 8/085; F21S 8/086
See application file for complete search history.

(56) References Cited

U.S. PATENT DOCUMENTS 6,250,774 B1 * 6/2001 Begemann ..... F21S 8/086 362/231
2008/0080178 A1 4/2008 Kita et al.
(Continued)

FOREIGN PATENT DOCUMENTS

EP 2019250 A1 1/2009
EP 2515030 A2 10/2012
(Continued)

OTHER PUBLICATIONS

Communication pursuant to Article 94(3) EPC in EP14828365.8, dated Mar. 15, 2018.

*Primary Examiner* — Alexander Garlen
(74) *Attorney, Agent, or Firm* — NLO N.V.; Catherine A. Shultz; Tamara C. Stegmann

(57) ABSTRACT

A light fixture is disclosed having a plurality of light sources belonging to at least two types emitting light of different S/P ratio. The light sources are placed in the light fixture so that the light fixture, when in use, emits a light bundle having varying S/P ratios within the bundle. In an embodiment the light bundle has a central area with low S/P ratio, and peripheral areas having higher S/P ratio. The S/P ratio in the peripheral areas can be as high as 5 or even higher. In an alternate embodiment the light bundle has a central area with relatively S/P ratio, and peripheral areas having lower S/P ratio. The S/P ratio in the peripheral areas can be as low as 2 or even lower.
The light fixtures are particularly suitable for outdoor lighting, for example street lighting.

19 Claims, 5 Drawing Sheets

(51) Int. Cl.

| | |
|---|---|
| ***F21V 7/00*** | (2006.01) |
| ***F21S 8/08*** | (2006.01) |
| *F21Y 105/10* | (2016.01) |
| *F21Y 115/10* | (2016.01) |
| *F21Y 113/10* | (2016.01) |

(52) U.S. Cl.
CPC ..... *F21Y 2105/10* (2016.08); *F21Y 2113/10* (2016.08); *F21Y 2115/10* (2016.08)

(56) References Cited

U.S. PATENT DOCUMENTS

| | | | | |
|---|---|---|---|---|
| 2010/0202140 | A1* | 8/2010 | Rooymans ..... | F21S 8/086<br>362/231 |
| 2010/0220471 | A1* | 9/2010 | Rooymans ..... | F21S 8/086<br>362/231 |
| 2010/0277097 | A1* | 11/2010 | Maxik ..... | F21S 2/00<br>315/294 |
| 2012/0268927 | A1* | 10/2012 | Saito et al. ..... | F21V 3/00<br>362/227 |
| 2012/0287618 | A1 | 11/2012 | Saito | |
| 2012/0306382 | A1 | 12/2012 | Maxik et al. | |
| 2014/0071677 | A1* | 3/2014 | Pickard et al. ..... | F21S 8/086<br>362/249.02 |

FOREIGN PATENT DOCUMENTS

| | | | |
|---|---|---|---|
| JP | 2012022986 | A | 2/2012 |
| WO | 2006132533 | A2 | 12/2006 |

* cited by examiner

MATERIALS AND PROCESS FOR SPATIAL S/P RATIO DISTRIBUTION

BACKGROUND OF THE INVENTION

1. Field of the Invention

The invention relates generally to a light fixture for use in mesopic lighting conditions, and more specifically to a light fixture emitting a light bundle of varying S/P ratios.

2. Description of the Related Art

Prior art light fixtures for mesopic lighting conditions, such as street lights, are designed to minimize power consumption. Sodium vapor discharge lights and mercury vapor discharge lights, for example, produce on the order of 30 to 200 lumens per Watt (not counting ballast loss). Specifically, mercury vapor lamps produce 32-63 lm/W; high pressure sodium lamps 40-140 lm/W; and low pressure sodium lamps up to 200 lm/W. However, in particular in the case of sodium vapor discharge lights, the Scotopic/Photopic (S/P) ratio is low.

There is a growing recognition that the measured lumens per Watt is a poor measure of a light's performance under mesopic lighting conditions. By definition, under mesopic light conditions the rods in the eye's retina make an important contribution to overall vision. The rods are most sensitive to light in the scotopic range of the spectrum. For best vision acuity under mesopic lighting conditions, the scotopic portion of the emitted light should be high relative to the photopic portion. This results in a high S/P ratio.

If high S/P ratio were the only consideration in designing light fixtures for mesopic lighting conditions, such light fixtures would use light sources emitting light in the cyan range of the spectrum. However, mankind is conditioned to experience cyan light as unpleasant. The human psychology desires white or orange light which, due to a low S/P ratio, is not optimum for mesopic lighting conditions.

US 2012/306382 discloses a light fixture comprising a light source and an ambient light sensor. The light fixture may comprise a light source emitting a first wavelength and a light source emitting a second wavelength. A microcontroller may switch on the light source of the second wavelength during critical times, so that its light combines with the light of the first wavelength.

EP 2 019 250 discloses a street lighting arrangement comprising a number of LED light sources and a reflector construction. The emitted light produces a generally uniform conical pattern.

US 2008/080178 discloses an illuminating device able to easily visualize a pedestrian on a footway along a roadway. The illuminating device illuminates the footway with blue-green color light, and the roadway with a green-red color light. The illuminating device creates a bundle of light of which the color varies in a direction perpendicular to the axis of the roadway.

EP 2 515 030 discloses a lighting device including a lower irradiation portion for irradiating light mainly in a vertically downward direction, and an upper irradiation portion for irradiating light more horizontally than the lower irradiation portion. The upper irradiation portion produces light of reduced S/P ratio, to reduce glare.

WO 2006/132533 discloses a lighting arrangement for illuminating a surface. The lighting arrangement comprises a solid state light source for generating light having a first wavelength in the range of 500-550 nm, and a solid state light source for generating light comprising wavelengths of 560-610 nm. The lighting arrangement is designed to generate light having a dominant wavelength such that the sensitivity of a human eye is dominated by rods.

US 2012/0287618 discloses an illuminating device for illuminating a walkway and a roadway. The walkway receives light of greater S/P ratio than the roadway. The illuminating device creates a bundle that varies in S/P ratio in a direction perpendicular to the axis of the roadway.

The prior art does not address the need for illuminating a roadway so as to improve the perceived uniformity of light intensity along the road axis.

Thus, there is a need for a street light fixture for use under mesopic lighting conditions emitting light that varies in S/P ratio in a direction generally parallel to the axis of the street or road being illuminated.

BRIEF SUMMARY OF THE INVENTION

The present invention addresses these problems by providing a street light fixture that, when in use, illuminates a street or road, said street or road having an axis, said street light fixture comprising a plurality of light sources of at least two types, each type being characterized by a Scotopic/Photopic ratio, the light sources being arranged within the light fixture so that the light fixture when in use emits a light bundle generally perpendicular to the axis of the street or road being illuminated, wherein light in the bundle has a Scotopic/Photopic ratio in function of a position within the bundle perpendicular to the axis of the street or road being illuminated.

As a result, the street light fixture creates a light bundle with varying S/P ratio in a direction generally parallel to the axis of the street or road being illuminated.

In an embodiment the light bundle has an S/P ratio that increases going from the central area of the bundle to the peripheral areas of the bundle. This results in a perception of a more uniform illumination of the street or roadway in the direction of travel, even though certain areas of the road surface are at a greater distance from the light fixture than are other areas.

In an alternate embodiment the light bundle has an S/P ratio that decreases going from the central area of the bundle to the peripheral areas of the bundle.

Another aspect of the invention comprises an arrangement of light fixtures wherein the peripheral areas of the light bundles of neighboring light fixtures overlap.

DETAILED DESCRIPTION OF THE INVENTION

Figure 1:
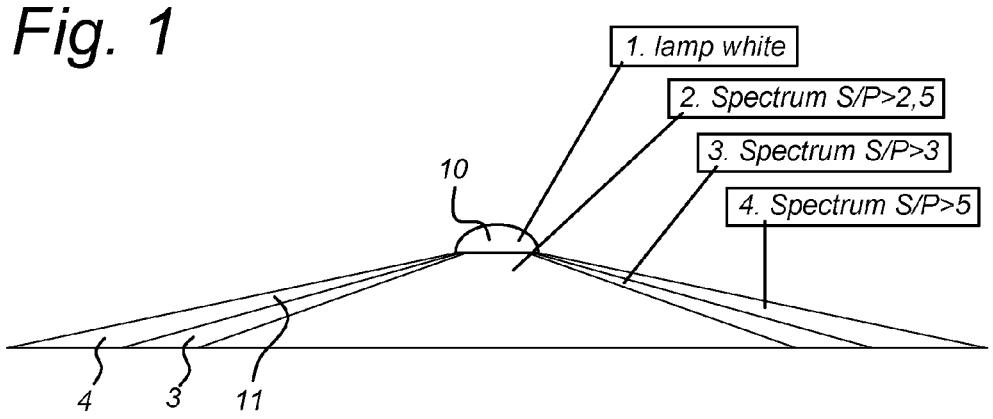
FIG. 1 shows a schematic representation of a light fixture according to the invention, viewed in a direction perpendicular to the axis of a street or road being illuminated by the light fixture.

The following is a detailed description of the invention.

Definitions

The term "photopic" as used herein means light as defined by the CIE as the V(λ) eye cones response curve of 1931. This is light with wavelengths in the range from 450 nm to 700 nm with a maximum eye efficacy of 683 lumens/Watt at 555 nm.

The term "scotopic" as used herein means light defined by the CIE as V'(λ) eye rods response. This is light with wavelengths in the range from 400 nm to 600 nm with a peak efficacy at 498 nm.

The term "mesopic" as used herein means light of a reduced intensity from 0.01 cd/m$^2$ to 3 cd/m$^2$. The upper limit of the mesopic intensity is not clearly defined but participation of rods rank up to 65 cd/m$^2$ (Bullough and Rea 2001). Optimal eye efficacy of 1700 lumens/Watt is found at 505 to 507 nm based on a combined response of rods and cones.

The term "scotopic/photopic ratio" or "S/P ratio" as used herein means the integral of the energy radiated in the scotopic response curve V'(λ) with the peak at 498 nm divided by the integral of the energy radiated in the photopic response curve V(λ).

In its broadest aspect the present invention relates to a light fixture comprising a plurality of light sources of at least two types, each type being characterized by a Scotopic/Photopic ratio, the light sources being arranged within the light fixture so that the light fixture when in use emits a light bundle wherein light in the bundle has a Scotopic/Photopic ratio in function of a position within the bundle. The invention further relates to a street light fixture that, when in use, illuminates a street or road, said street or road having an axis, said street light fixture comprising a plurality of light sources of at least two types, each type being characterized by a Scotopic/Photopic ratio, the light sources being arranged within the light fixture so that the light fixture when in use emits a light bundle that is elongate with respect to the axis of the street or road being illuminated, wherein light in the bundle has a Scotopic/Photopic ratio in function of a position within the bundle along the axis of the street or road being illuminated.

In a preferred embodiment the light sources comprise LED light sources. The LED light sources may comprise at least one cyan LED light source, that is, a LED light source emitting light having a spectral distribution with a peak at or near 490 to 520 nm. In addition the LED light sources may comprise at least one red LED light source, that is, a LED light source emitting light having a spectral distribution with a peak in the range of from about 600 nm to about 660 nm.

In addition the LED light sources may comprise at least one blue LED light source, that is, a LED light source emitting light having a spectral distribution with a peak in the range of from about 400 nm to about 470 nm.

The light sources are placed within the light fixture so that the light fixture, in use, emits a bundle of light wherein light in the bundle has a Scotopic/Photopic ratio in function of a position within the bundle. For example, the S/P ratio of light within the bundle may vary from about 2.5 to at least 2.9, preferably from about 2.5 to at least 4.0, more preferably from about 2.5 to at least 5.0.

The portion of the bundle having high S/P ratio emanates primarily or exclusively from the type of light source within the fixture that is characterized by a high S/P ratio, such as one or more cyan LEDs. It is possible to construct cyan LEDs emitting virtually no light in the photopic peak range of the spectrum at 555 nm. The S/P ratio of such a light source approaches infinity. Accordingly, there is no upper limit to the S/P ratio that can be produced within the light bundle.

The portion of the bundle having relatively low S/P ratio, for example in the range of from about 2.5 to about 2.7, emanates from light sources of different types. For example, this light may be a mixture of light from one or more cyan LEDs and one or more red LEDs. In a preferred embodiment this light further contains light from one or more blue LEDs. The different types of light sources are balanced so as to produce a white light, preferably a white light having a color temperature in the range of from about 3500 K to about 6500 K.

It is known to use a so-called "phosphor" to convert light from, for example, a blue LED to white light. Such phosphors contain chemical compounds that absorb light of a short wavelength (such as blue light) and emit light of a longer wavelength. LEDs equipped with phosphors are suitable for use in the light fixtures of the present invention. However, the conversion to light of longer wavelengths is associated with a loss of energy. Moreover, phosphor layers have a shorter useful life than a phosphor-less, or "bare" LED, so the use of phosphors reduces the actual useful life of a LED light source.

It will be understood that the use of LEDs of different color in the light fixture of the present invention makes it possible to create white light without the use of phosphors. Avoiding phosphors avoids the energy loss and the life expectancy penalties associated with phosphors. For these reasons phosphor-less LEDs are preferred for use in the light fixtures of the present invention.

In an embodiment the light bundle emitted by the light fixture has a central area and peripheral areas. Light in the central area of the light bundle has substantial S/P ratio, for example from about 2.5 to about 2.7. Light in the peripheral areas has a higher S/P ratio, for example at least 2.9, preferably at least 4, more preferably at least 5. The S/P ratio in the central area of the light bundle corresponds with light that is perceived as white, for example warm white light. Light in the peripheral areas of the light bundle is generally of lower intensity than light in the central area of the light bundle. This difference in light intensity is wholly or partially compensated by the higher S/P ratio in the peripheral areas of the light bundle. The perceived light intensity is based on measured intensity multiplied by the S/P ratio to the power of 0.8.

In many cases, in particular in outdoor lighting situations, it is desirable to provide lighting that is as even as possible, yet prohibitively expensive to do so. For example, highway lighting is ideally of even intensity along a stretch of highway, also called uniformity. But, unavoidably, the light intensity drops exponentially with the distance to a street light. As a result the light forms a pattern with areas of greater light intensity near the street lights, and areas of lower light intensity in between. The effect can be mitigated by placing the street lights closer together, but this approach carries a cost both in terms of capital expenditure (an increased number of street lights per kilometer) and operation costs (increased power consumption and maintenance costs).

The light fixture of an embodiment of the present invention significantly reduces this problem by providing light having higher S/P ratio in the peripheral areas of the light bundle. Inevitably the light intensity in the peripheral areas of the light bundle is lower than in the central area. But due to the higher S/P ratio in the peripheral areas the vision acuity in the peripheral areas is far greater than the drop-off in light intensity would suggest and thus improving the perceived uniformity of the light along the axis of the street or road being illuminated.

Another aspect of the invention is a lighting arrangement comprising at least two light fixtures according to the invention. The light fixtures in the arrangement may be of the type emitting a light bundle having a central area and peripheral areas, the central area having low S/P ratio and the peripheral areas having high S/P ratio. The light fixtures in the arrangement are preferably placed so that the peripheral areas of the light bundles of neighboring light fixtures overlap.

The lighting arrangement may create a lighting pattern comprising bright areas and dim areas. The bright areas receive light having S/P ratio, for example in the range of from 2.5 to 2.7. The dim areas receive light high having high S/P ratio, for example in the range of from 2.7 to at least 4 or 5. It will be understood that the light intensity within the dim areas may gradually decrease as the distance to the nearest light fixture increases. In an embodiment the S/P ratio of the light in the dim areas increases as the light intensity decreases.

In an embodiment the light fixtures are arranged within the lighting arrangement are placed so that at least parts of the dim areas receive light from at least two light fixtures.

In an alternate embodiment the S/P ratio in the peripheral areas of the light bundle is lower than the S/P ratio in the central area of the light bundle. It is known that light having high S/P ratio increases peripheral vision, due to the placement of the rods in the retina. Some lighting experts hold the view that peripheral vision is a cause of distraction during driving, and should be avoided. Standard sodium vapor discharge lamps have very low S/P ratio, and are believed to favor such undistracted far distance vision.

The light fixture of the invention can be designed to suppress peripheral vision by emitting light bundles having a substantial S/P ratio, for example in the range of 2.5 to 2.7, in the center, and a lower S/P ratio, for example 2 or less, in the peripheral areas. This can be accomplished by rotating the light source 180 degree in the embodiment emitting mixed cyan+red or cyan+red+blue light in the center of the bundle, and predominantly red light in the peripheral areas of the bundle. These embodiments have the added benefit of emitting orange light when viewed from a distance, which is perceived as "warm" and "safe" in certain cultures.

DESCRIPTION OF ILLUSTRATIVE EMBODIMENTS/EXAMPLES

The following is a description of certain embodiments of the invention, given by way of example only.

FIG. 1 is a schematic representation of a light fixture according to the invention. Light fixture 10 emits a light bundle 11. Light fixture 10 has a white light source 1. Light bundle 11 has a central area 2; a first peripheral area 3; and a second peripheral area 4.

In an embodiment, the central area 2 has light having an S/P ratio of 2.5 to 2.7; first peripheral area 3 has light having an S/P ratio of more than 3; and second peripheral area 4 has light having an S/P ratio of more than 5.

In an alternate embodiment the central area 2 has light having an S/P ratio of 2.5 to 2.7; first peripheral area 3 has light having an S/P ratio of 1 to 2.5; and second peripheral area 4 has light having an S/P ratio of less than 1.

FIG. 2 shows an embodiment of the light fixture of the invention. Light source 10 is a flat plate having arranged thereon a plurality of light emitting diodes. Light source 10 is placed at an angle relative to the central plane of the light fixture (not shown). Depending on the viewing angle, the edge of the light fixture (schematically depicted as plate 12) may partially obscure light source 10.

Figure 2A:
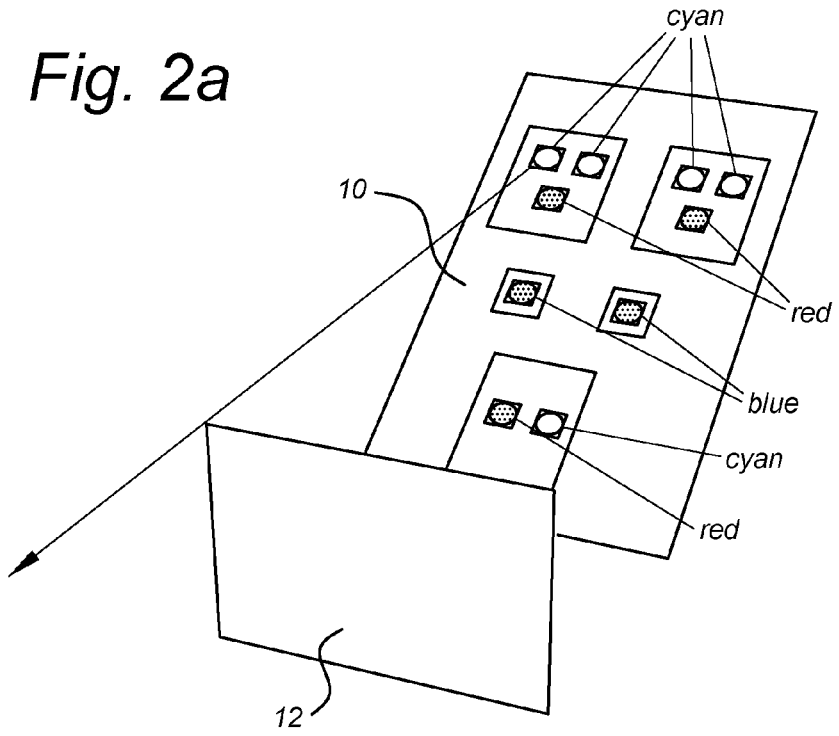
FIG. 2 shows an embodiment of a light fixture according to the invention.
Figure 2B:
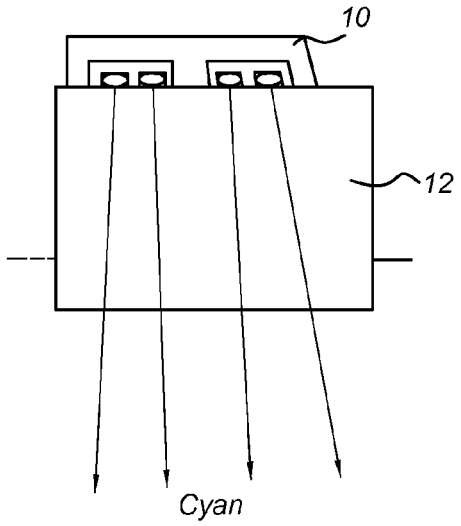

FIG. 2B shows the light fixture viewed from a distance. The LEDs in the lower portion of light source 10 are all obscured from view; only the topmost row of cyan LEDs is visible. The viewer receives cyan light from the light fixture, having an S/P ratio of more than 5.

Figure 2C:
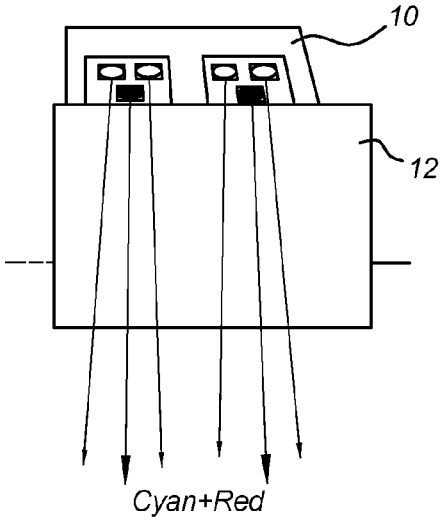

FIG. 2C shows the situation as the viewer has moved closer to the light fixture relative to FIG. 2B. The viewer now received light from cyan LEDs and from red LEDs. The light received in FIG. 2C has lower S/P ratio than that of FIG. 2B.

Figure 2D:
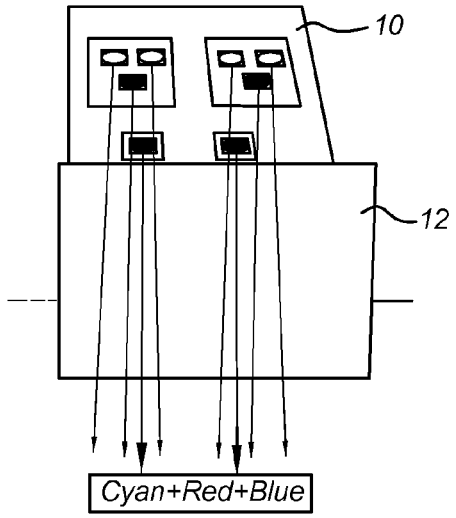
Figure 3A:
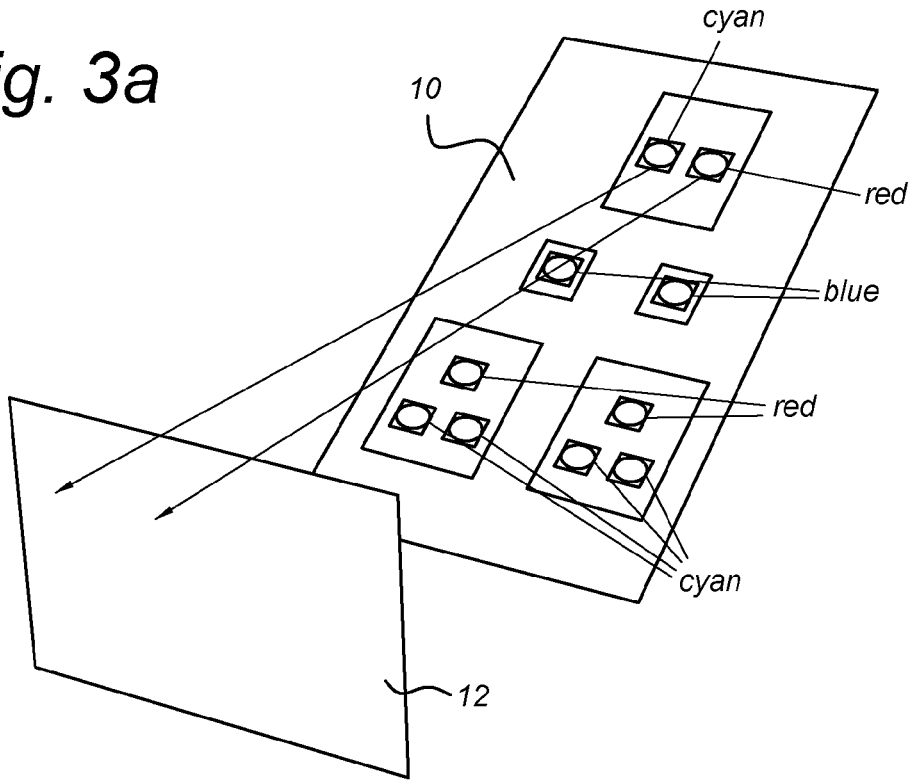
FIG. 3 shows an alternate embodiment of the inventive light fixture.
Figure 3B:
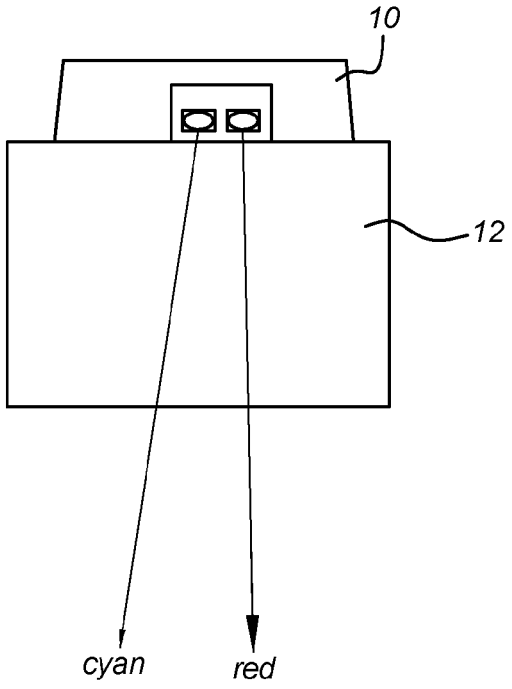
Figure 3C:
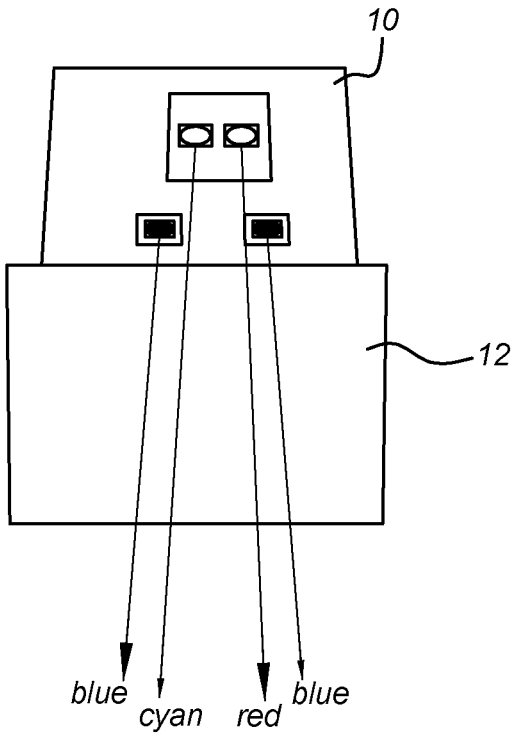
Figure 3D:
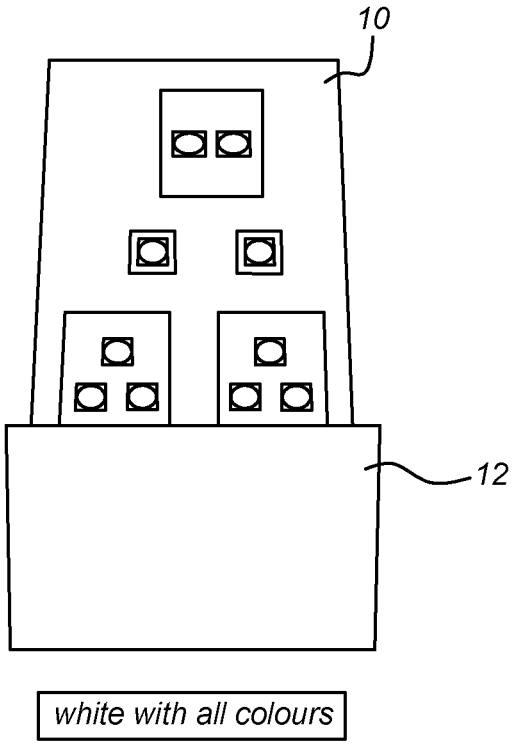

In FIG. 2D the viewer has moved still closer to the light fixture, and now receives light that is a mixture of cyan, red and blue, and is perceived as white. When the viewer moves still closer to the light fixture he receives light from all LEDs of light source 10.

FIG. 3 shows an alternate embodiment of the invention. The set-up is similar to that of FIG. 2, but the positions of the red and cyan LEDs have been changed by rotating the light source 180 degrees. As a result, from a distance the viewer received red light from the light fixture (FIG. 3B); from a closer viewpoint the viewer receives a mixture of red and cyan, with the red portion dominant (FIG. 3C); from a yet closer position the viewer receives a mixture of red, cyan and blue light, perceived as white. In this embodiment the S/P ratio of the light increases as one moves from the periphery of the light bundle to the center. Observing the lamps in a continuous row along a street will give the viewer the impression of the well known LPS and HPS (sodium) lamps.

Figure 4:
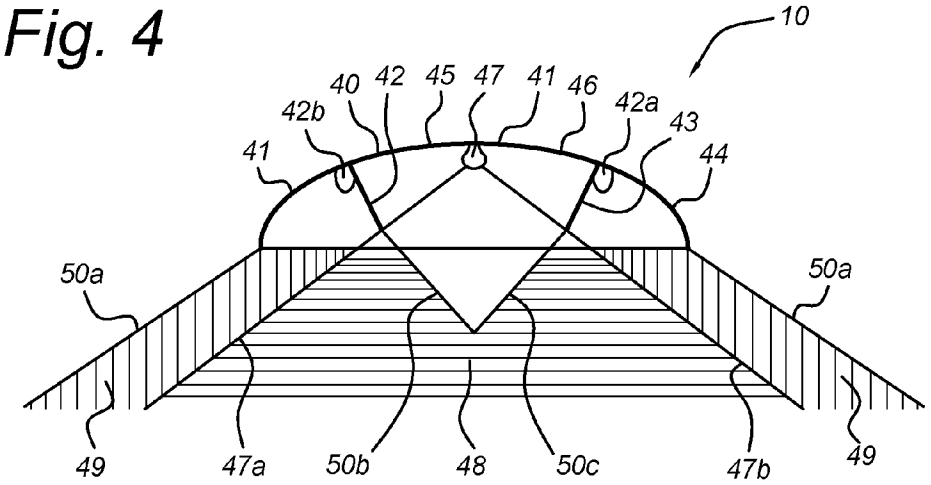
FIG. 4 shows a schematic representation of an alternate embodiment of the light fixture according to the invention, viewed in a direction perpendicular to the axis of a street or road being illuminated by the light fixture.

FIG. 4 shows yet another embodiment of the invention. Light source 10 comprises a reflector 40, which has curved portions 41, 44, 45 and 46, and flat portions 42 and 43. Flat portions 42 and 43 are reflective on both sides. Light source 10 comprises a first LED 47 placed in or near the center of reflector 40. First LED 47 can also be an array of a plurality of LEDs. First LED or LEDs 47 emit a light bundle that is bordered by lines 47*a* and 47*b*.

Second LEDs 42*a* and 42*b* are placed adjacent to reflector surfaces 43 and 42, respectively. Second LED 42*a* emits a light bundle bordered by lines 50*c* and 50*d*; second LED 42*b* emits a light bundle bordered by lines 50*a* and 50*b*.

Due to the relative placement of the LEDs to reflector 41, the light fixture of FIG. 4 emits a light bundle having a central area 48 and peripheral areas 49. Central area 48 has light that is a mixture of light from LEDs 47, 42*a* and 42*b*. Peripheral areas 49 receive light from LEDs 42*a* and 42*b*.

In an embodiment LED or LEDs 47 emit red light, and LEDs 42*a* and 42*b* emit cyan light. Central area 48 of the light bundle has light that is a mixture of cyan and red; peripheral areas 49 have cyan light. The S/P ratio of the peripheral areas 49 is significantly higher than central area 48.

In an alternate embodiment LEDs 47 are a combination of red and blue LEDs. Central area 48 receives light that is a mixture of red, blue and cyan; peripheral areas 49 receive cyan light.

In yet another embodiment LEDs 42*a* and 42*b* emit red light, and LEDs 47 emit cyan light. Peripheral areas 49 receive red light; central are 48 receives light that is a mixture of red and cyan. The peripheral areas 49 have an S/P ratio that is significantly lower than the central area 48.

In yet another embodiment LEDs 42*a* and 42*b* emit red light. LEDs 47 are a combination of cyan and blue LEDs. Central area 48 receives light that is a combination of red, cyan and blue light. Peripheral areas 49 receive red light. The peripheral areas 49 have an S/P ratio that is significantly lower than the central area 48.

Figure 5:
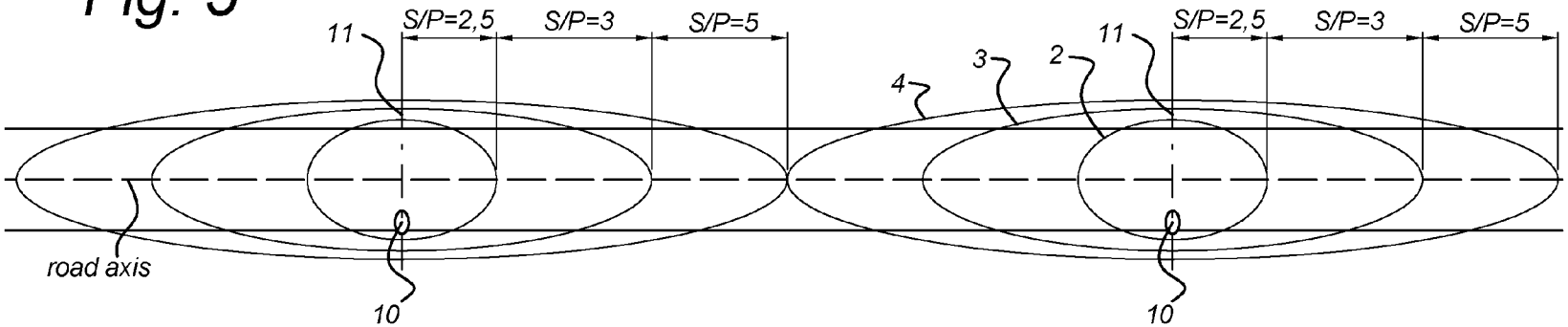
FIG. 5 shows a plan view of a street illuminated by a pair of light fixtures according to FIG. 1.

FIG. 5 shows a plan view of a street illuminated by a pair of light fixtures according to FIG. 1. As can be seen in this view, the light fixtures 10 emit light bundles 11 that are elongate and aligned along the road axis. Light bundles 11 have a central area 2; a first peripheral area 3; and a second peripheral area 4. In this embodiment, the central area 2 has light having an S/P ratio of 2.5; first peripheral area 3 has light having an S/P ratio of 3; and second peripheral area 4 has light having an S/P ratio of 5. The light fixtures 10 are located such that the light bundles 11 overlap or at least engage at their peripheries.

Thus, the invention has been described by reference to certain embodiments discussed above. It will be recognized that these embodiments are susceptible to various modifications and alternative forms well known to those of skill in the art.

Many modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A street light fixture that, when in use, illuminates a street or road, said street or road having an axis, said street light fixture comprising a housing; a plurality of light sources of at least three types arranged within the housing, each type being characterized by a different Scotopic/Photopic (S/P) ratio, the light sources being arranged within the light fixture so that the light fixture when in use emits a light bundle that is elongate with respect to the axis of the street or road being illuminated, wherein light in the bundle has an S/P ratio in function of a position within the bundle along the axis of the street or road being illuminated and wherein the housing or another portion of the street light fixture at least partially obscures or blocks at least one of the plurality of light sources when viewed from peripheral areas at a distance from the light fixture such that the S/P ratio varies in a direction parallel to the axis and increases going from a central area beneath the light fixture to the peripheral areas distanced from the light fixture.

2. The light fixture of claim 1 wherein the light sources are LED light sources.

3. The light fixture of claim 2 wherein the LED light sources comprise at least one cyan LED light source.

4. The light fixture of claim 2, wherein the LED light sources comprise at least one red LED light source.

5. The light fixture of claim 2, wherein the LED light sources comprise at least one blue LED light source.

6. The light fixture of claim 1, wherein the S/P ratio within the bundle ranges from about 2.5 to at least 2.9.

7. The light fixture of claim 6 wherein the S/P ratio within the bundle ranges from about 2.5 to at least 5.0.

8. The light fixture of claim 1, wherein light in the central area has an S/P ratio of about 2.5 and light in the peripheral areas has an S/P ratio of at least 2.9.

9. The light fixture of claim 8 wherein light in the peripheral areas has an S/P ratio of at least 5.0.

10. The light fixture of claim 1, further comprising a reflector, said reflector having a central area and peripheral areas, wherein light sources having a low S/P ratio are placed in the central area of the reflector.

11. The light fixture of claim 10 wherein light sources having high S/P ratio are placed in a peripheral area of the reflector.

12. The light fixture of claim 10 wherein light sources having a low S/P ratio are placed in a peripheral area of the reflector.

13. The street light fixture of claim 1, wherein a shield or a reflector at least partially obscure or block at least one of the plurality of light sources when viewed from peripheral areas at a distance from the light fixture.

14. A lighting arrangement comprising at least two light fixtures arranged to illuminate a street or road, said street or road having an axis, each light fixture comprising a housing; a plurality of light sources of at least three types arranged within the housing, each type being characterized by a different Scotopic/Photopic (S/P) ratio, the light sources being arranged within the respective light fixture such that the light fixture emits a light bundle that is elongate with respect to the axis of the street or road being illuminated, wherein light in each bundle has an S/P ratio in function of a position within the bundle along the axis of the street or road being illuminated and wherein the housing or another portion of the street light fixture at least partially obscures or blocks at least one of the plurality of light sources when viewed from peripheral areas at a distance from the light fixture such that the S/P ratio varies in a direction parallel to the axis and increases going from a central area beneath the light fixture to the peripheral areas distanced from the light fixture and the light fixtures are spaced along the road so that the peripheral areas of the light bundles of neighboring light fixtures overlap.

15. The lighting arrangement of claim 14 creating a lighting pattern comprising bright areas and dim areas, wherein the bright areas receive light having S/P ratio in the range of from 2.5 to 2.7, and the dim areas receive light having S/P ratio in the range of from 2.7 to at least 5.0.

16. The lighting arrangement of claim 14 creating a lighting pattern comprising bright areas and dim areas, wherein the bright areas receive light having S/P ratio in the range of from 2.5 to 2.7, and the dim areas receive light having S/P ratio in the range of from 1.7 to at least 2.4.

17. The lighting arrangement of claim 15, wherein at least parts of the dim areas receive light from at least two light fixtures.

18. The lighting arrangement of claim 16, wherein at least parts of the dim areas receive light from at least two light fixtures.

19. The lighting arrangement of claim 14, wherein a shield or a reflector at least partially obscure or block at least one of the plurality of light sources when viewed from peripheral areas at a distance from the light fixture.

* * * * *